US010520869B2

(12) United States Patent
Yamamoto

(10) Patent No.: US 10,520,869 B2
(45) Date of Patent: Dec. 31, 2019

(54) FIXING DEVICE AND IMAGE FORMING APPARATUS

(71) Applicant: Konica Minolta, Inc., Chiyoda-ku, Tokyo (JP)

(72) Inventor: Naoki Yamamoto, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/361,090

(22) Filed: Mar. 21, 2019

(65) Prior Publication Data

US 2019/0310574 A1 Oct. 10, 2019

(30) Foreign Application Priority Data

Apr. 6, 2018 (JP) ..... 2018-073761

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2057; G03G 15/206
See application file for complete search history.

(56) References Cited

U.S. PATENT DOCUMENTS

2015/0030360 A1* 1/2015 Saiki ..... G03G 15/2064 399/329
2016/0154353 A1* 6/2016 Yotsutsuji ..... G03G 15/2053 399/329

FOREIGN PATENT DOCUMENTS

JP 2014-134701 A 7/2014
JP 2016-142987 A 8/2016

* cited by examiner

*Primary Examiner* — Hoang X Ngo
(74) *Attorney, Agent, or Firm* — Squire Patton Boggs (US) LLP

(57) ABSTRACT

The fixing device includes an endless fixing belt, a pressing member, a pressing rotator, and a heating unit. The pressing member includes a counter face that faces the inner peripheral surface of the fixing belt. The counter face includes a curved portion that is concavely curved and an extended portion. The shape of the curved portion in a cross section orthogonal to the width direction of the fixing belt is configured to approach the center of the pressing rotator as it extends toward the downstream in the conveying direction. The extended portion is continuous with the curved portion and is provided at the downstream of the curved portion in the conveying direction of the recording medium. The shape of the extended portion in the cross section is configured to leave away from the center of the pressing rotator as it extends toward the downstream in the conveying direction.

10 Claims, 10 Drawing Sheets

FIG.9

| | ANGLE β [° ] | PEAK PRESSURE | CURL |
|---|---|---|---|
| COMPARATIVE EXAMPLE 1 | −15 | UNACCEPTABLE | UNACCEPTABLE |
| COMPARATIVE EXAMPLE 2 | −10 | UNACCEPTABLE | SATISFACTORY |
| COMPARATIVE EXAMPLE 3 | −5 | UNACCEPTABLE | SATISFACTORY |
| COMPARATIVE EXAMPLE 4 | 0 | UNACCEPTABLE | SATISFACTORY |
| EXAMPLE 1 | 0.5 | ACCEPTABLE | SATISFACTORY |
| EXAMPLE 2 | 5 | SATISFACTORY | SATISFACTORY |
| EXAMPLE 3 | 10 | SATISFACTORY | SATISFACTORY |
| COMPARATIVE EXAMPLE 5 | 15 | SATISFACTORY | UNACCEPTABLE |

FIXING DEVICE AND IMAGE FORMING APPARATUS

The entire disclosure of Japanese patent Application No. 2018-073761 filed on Apr. 6, 2018 is incorporated herein by reference in its entirety.

BACKGROUND

Technological Field

The present invention relates to a fixing device and an image forming apparatus.

Description of the Related Art

For example, Japanese Laid-Open Patent Publication No. 2014-134701 and Japanese Laid-Open Patent Publication No. 2016-142987 disclose a technique for fixing a toner image on a recording medium by using a fixing nip formed by a pad disposed inside the inner periphery of an endless belt and a roller facing the pad.

SUMMARY

In the fixing device disclosed in Japanese Laid-Open Patent Publication No. 2014-134701 and Japanese Laid-Open Patent Publication No. 2016-142987 mentioned above, in order to ensure satisfactory fixability, it is desired that a nip pressure applied by the fixing nip increases toward the downstream in the conveying direction of the recording medium. However, in the fixing device mentioned above, the nip pressure peaks at the most downstream portion of the pad in the conveying direction, whereby the bite amount of the pad into the roller increases. As the bite amount into the roller increases, the recording medium may be discharged obliquely relative to the desired conveying direction, which may makes it difficult to separate the recording medium from the belt with sufficient separability.

An object of the present invention is to provide a fixing device and an image forming apparatus capable of providing both satisfactory fixability and separability.

To achieve at least one of the abovementioned objects, according to an aspect of the present invention, a fixing device reflecting one aspect of the present invention is configured to fix a toner image on a recording medium and includes an endless fixing belt, a pressing member, a pressing rotator, and a heating unit configured to heat the fixing belt. The pressing member is disposed inside the inner periphery of the fixing belt. The pressing member includes a counter face that faces the inner peripheral surface of the fixing belt. The pressing rotator is disposed to face the pressing member with the fixing belt interposed therebetween. The pressing rotator forms a fixing nip with the pressing member. The counter face includes a curved portion that is concavely curved and an extended portion. The shape of the curved portion in a cross section of the pressing member orthogonal to the width direction of the fixing belt is configured to approach the center of the pressing rotator as it extends toward the downstream in the conveying direction. The extended portion is continuous with the curved portion. The extended portion is provided at the downstream of the curved portion in the conveying direction of the recording medium. The shape of the extended portion in the cross section is configured to leave away from the center of the pressing rotator as it extends toward the downstream in the conveying direction.

To achieve at least one of the above mentioned objects, an image forming apparatus reflecting one aspect of the present invention comprises the fixing device according to any one of the above aspects and a housing unit configured to house the recording medium.

The foregoing and other objects, features, aspects and advantages of the present invention will become more apparent from the following detailed description of the present invention when taken in conjunction with the accompanying drawings.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention.

FIG. 9 is a table listing the evaluation results of each pressing member according to Example 1 to Example 3 and Comparative Example 1 to Comparative Example 5.

DETAILED DESCRIPTION OF EMBODIMENTS

Figure 1:
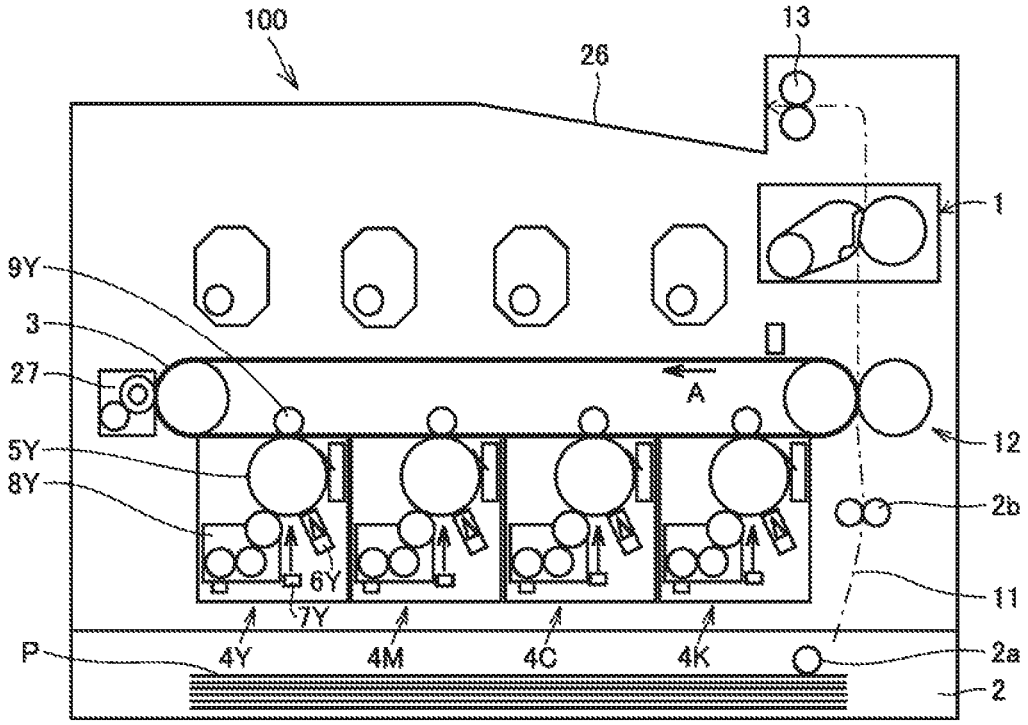
FIG. 1 is a schematic diagram illustrating an image forming apparatus according to a first embodiment.

Hereinafter, one or more embodiments of the present invention will be described with reference to the drawings. However, the scope of the invention is not limited to the disclosed embodiments. It should be noted that the same or equivalent portions in the following drawings will be denoted by the same reference numerals, and the description thereof will not be repeated.

<Image Forming Apparatus 100>

FIG. 1 is a schematic diagram illustrating an image forming apparatus 100 according to a first embodiment. The image forming apparatus 100 according to the first embodiment is called as a tandem type color image forming apparatus. The image forming apparatus 100 includes an intermediate transfer belt 3 as a belt member, image forming units 4Y, 4M, 4C and 4K, a secondary transfer unit 12, and a fixing device 1.

The intermediate transfer belt 3 is configured to rotate counterclockwise (in the direction indicated by an arrow A in FIG. 1). The four image forming units 4Y, 4M, 4C and 4K corresponding to respective colors of yellow (Y), magenta (M), cyan (C) and black (K) are disposed below the intermediate transfer belt 3 and arranged side by side along the intermediate transfer belt 3.

Hereinafter, the configuration relating to yellow (Y) among the colors of yellow (Y), magenta (M), cyan (C) and black (K) will be described in detail, and the configuration relating to magenta (M), cyan (C) or black (K) is the same as that of yellow (Y).

The image forming unit 4Y includes a photoreceptor drum 5Y, a charging unit 6Y, an image exposing unit 7Y, a developing unit 8Y, and a primary transfer roller 9Y. The photoreceptor drum 5Y rotates clockwise. The charging unit 6Y, the image exposing unit 7Y, the developing unit 8Y and the primary transfer roller 9Y are disposed in this order around the photoreceptor drum 5Y along the rotation direction of the photoreceptor drum 5Y. The primary transfer roller 9Y is arranged to face the photoreceptor drum 5Y with the intermediate transfer belt 3 interposed therebetween.

The operations of the image forming apparatus 100 will be described schematically. The image forming apparatus 100 further includes a controller (not shown). The controller includes an image signal processor (not shown). When an image signal is input from an external device (for example, a personal computer), the image signal processor creates a digital image signal by converting the image signal into colors of yellow, cyan, magenta and black. The controller controls the image exposing unit 7Y to expose the photoreceptor drum 5Y based on the digital image signal. As a result, an electrostatic latent image is formed on the photoreceptor drum 5Y. A developing bias is applied to the developing unit 8Y so as to develop the electrostatic latent image into a toner image.

A transfer bias is applied to each of the primary transfer rollers 9Y, 9M, 9C and 9K so as to transfer (primary transfer) the color toner images developed respectively by the developing units 8Y, 8M, 8C and 8K onto the intermediate transfer belt 3 rotating in the direction of arrow A and superimpose the same in order on the intermediate transfer belt 3. The color toner images primarily transferred to the intermediate transfer belt 3 are conveyed to a secondary transfer unit 12 along a conveying path 11.

The image forming apparatus 100 further includes a detachable housing unit 2, a paper feeding roller 2*a*, and a resistance roller 2*b*. The housing unit 2 is configured to house a recording medium. In the present embodiment, the recording medium is plain paper P. The sheets of plain paper P stacked and housed in the housing unit 2 are conveyed one by one toward the resistance roller 2*b* in accordance with the rotation of the paper feeding roller 2*a* and conveyed from the resistance roller 2*b* to the secondary transfer unit 12 along the conveying path 11.

A transfer bias is applied to the secondary transfer unit 12 so as to transfer (secondary transfer) the toner images of respective colors primarily transferred and superimposed on the intermediate transfer belt 3 onto the plain paper P conveyed from the housing unit 2. After the color toner images are secondarily transferred onto the plain paper P, the plain paper P is conveyed to the fixing device 1.

The image forming apparatus 100 further includes a cleaning unit 27. The cleaning unit 27 is configured to clean the toner remained on the intermediate transfer belt 3 after the color toner images are transferred onto the plain paper P in the secondary transfer unit 12.

The fixing device 1 is disposed at the downstream of the conveying path 11 relative to the secondary transfer unit 12. The plain paper P transferred with the toner image is conveyed to pass through the fixing device 1. When being conveyed to pass through the fixing device 1, the plain paper P is pressed and heated by the fixing device 1. As a result, the toner image is fixed on the plain paper P. The plain paper P with the toner image fixed thereon is discharged to a paper discharge tray 26 via a paper discharge roller 13.

(Fixing device 1)

Figure 2:
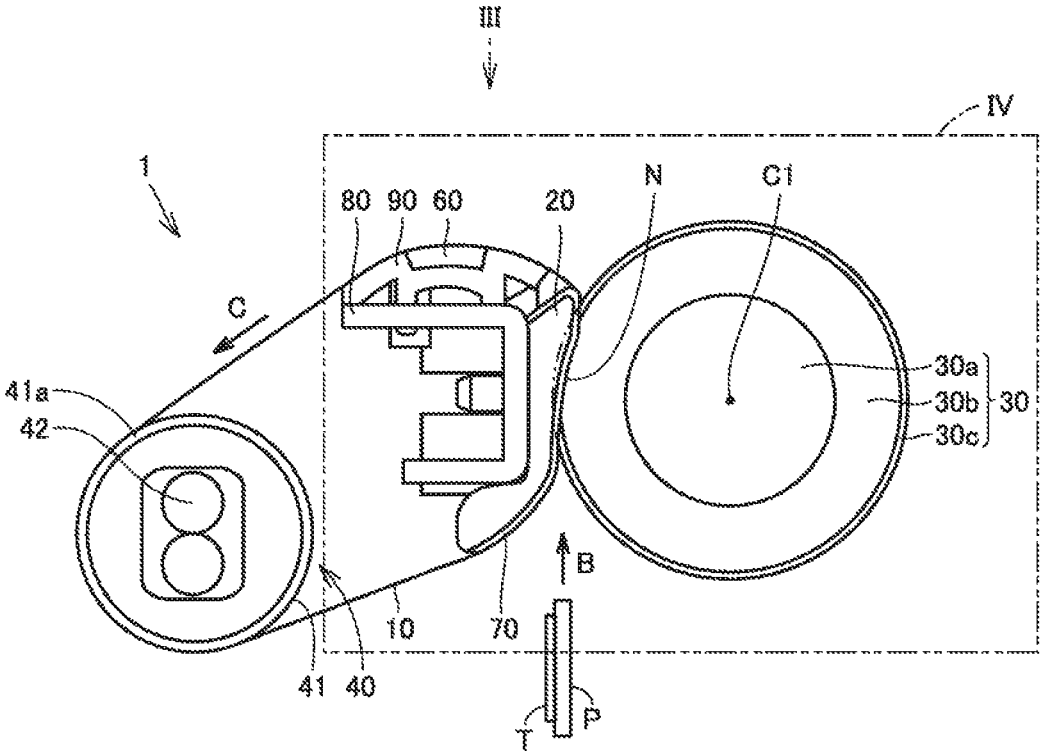
FIG. 2 is a cross sectional view schematically illustrating the fixing device according to the first embodiment.
Figure 3:
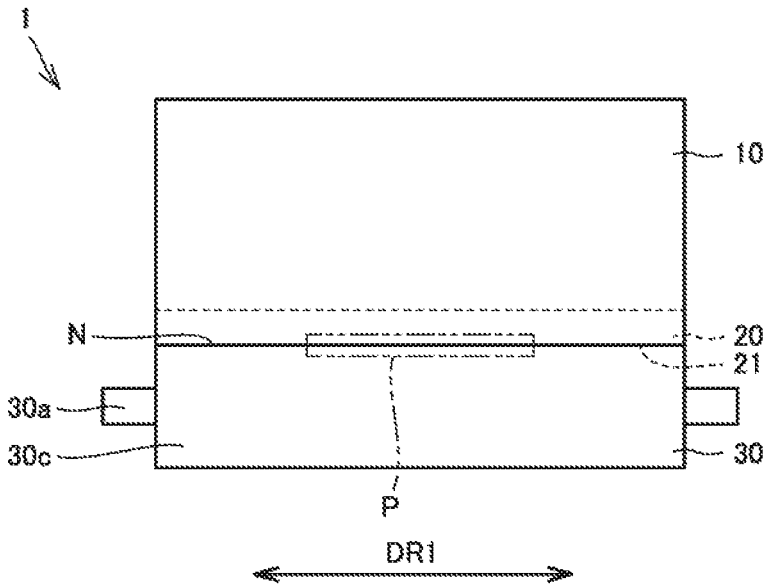
FIG. 3 is a view illustrating the schematic configuration of the fixing device when viewed from the direction indicated by an arrow III in FIG. 2.

FIG. 2 is a cross sectional view schematically illustrating the fixing device 1 according to the first embodiment. FIG. 3 is a view illustrating the schematic configuration of the fixing device 1 when viewed from the direction indicated by an arrow III in FIG. 2. The fixing device 1 will be described with reference to FIGS. 2 and 3.

The fixing device 1 includes an endless fixing belt 10, a heating unit 40, a pressing rotator 30, a pressing member 20, and a fixing member 80.

The fixing belt 10 is composed of a base layer, an elastic layer and a release layer (not shown). Although the outer diameter of the endless fixing belt 10 is arbitrary, it is preferably 10 mm or more and 100 mm or less. The base layer is made of polyimide, SUS, electroformed nickel or the like. The thickness of the base layer is preferably 5 μm or more and 100 μm or less. The elastic layer is preferably made of a material having high heat resistance such as silicone rubber or fluorine rubber. The thickness of the elastic layer is preferably 10 μm or more and 300 μm or less. The release layer is preferably formed as a fluorine tube or a fluorine-based coating that has release property. The thickness of the release layer is preferably 5 μm or more and 100 μm or less.

The two-direction arrow illustrated in FIG. 3 indicates a width direction DR1. The width direction DR1 is the direction of width of the fixing belt 10, which is orthogonal to the conveying direction of the plain paper P (the direction indicated by an arrow B in FIG. 2). The width direction DR1 corresponds to the horizontal direction in FIG. 3. The width direction DR1 is substantially parallel to the axial direction of the pressing rotator 30 which will be described later.

In the present embodiment, the heating unit 40 is disposed inside the inner periphery of the fixing belt 10. The heating unit 40 includes a heating roller 41 and a halogen lamp 42 serving as a heating source. The halogen lamp 42 is disposed inside the inner periphery of the heating roller 41. The halogen lamp 42 is configured to heat the fixing belt 10 through the intermediary of the heating roller 41.

The heating roller 41 is cylindrical and is made of a metal such as aluminum or stainless steel (SUS). Although the outer diameter of the heating roller 41 is arbitrary, it is preferably 10 mm or more and 100 mm or less, and the thickness of an outer peripheral portion 41*a* of the heating roller 41 is preferably 0.1 mm or more and 5 mm or less. When the halogen lamp 42 is used as the heat source, it is preferable that the inner peripheral surface of the heating roller 41 is made black. In order to prevent the outer peripheral surface from being damaged by foreign matters or the like, the outer peripheral surface of the heating roller 41 may be coated by polytetrafluoroethylene (PTFE) or the like.

In addition to the halogen lamp 42, the heat source may be configured to heat the heating roller 41 and the fixing belt 10 via induction heating (IH) or cause the heating roller 41 and the fixing belt 10 to generate heat as a heating resistor.

The pressing member 20 is disposed inside the inner periphery of the fixing belt 10. The pressing member 20 is arranged to face the inner peripheral surface of the fixing belt 10. In the present embodiment, the pressing member 20 is a pad. The pressing member 20 is configured to extend in the width direction DR1. The pressing member 20, for example, is made of resin such as polyphenylene sulfide, polyimide or liquid crystal polymer, metal such as aluminum or iron, and ceramic. The pressing member 20 may be formed into a two-part unit by further including a separate member made of silicone rubber, fluorine rubber or the like. The details of the pressing member 20 will be described later.

The fixing member 80 is disposed inside the inner periphery of the fixing belt 10. The fixing member 80 is disposed opposite to the pressing rotator 30 relative to the pressing member 20. The fixing member 80 is configured to fix the pressing member 20 in position.

The pressing rotator 30 is arranged to face the pressing member 20 with the fixing belt 10 interposed therebetween. In the present embodiment, the pressing rotator 30 is a pressing roller. The pressing rotator 30 forms a fixing nip N with the pressing member 20. The pressing rotator 30 is configured to press the pressing member 20 with a predetermined pressure applied by a pressing mechanism (not shown) such as a spring or the like. The pressing rotator 30 is driven to rotate at a predetermined rotational speed by a driving device such as a motor (not shown). The pressing rotator 30 rotates around a center C1. Although the outer diameter of the pressing rotator 30 is arbitrary, it is preferably 20 mm or more and 100 mm or less.

The pressing rotator 30 includes a cylindrical mandrel 30*a*, an elastic layer 30*b* covering the mandrel 30*a*, and a release layer 30*c* covering the elastic layer 30*b*. The mandrel 30*a* is preferably made of metal such as aluminum or iron. The thickness of the mandrel 30*a* is preferably 0.1 mm or more and 10 mm or less. The mandrel 30*a* may be solid or may have a special cross-sectional shape such as a three-arrow shape. The elastic layer 30*b* is preferably made of a material having high heat resistance such as silicone rubber or fluorine rubber. The thickness of the elastic layer 30*b* is preferably 1 mm or more and 20 mm or less. The release layer 30*c* is preferably formed as a fluorine tube or a fluorine-based coating that has release property. The thickness of the release layer 30*c* is preferably 5μm or more and 100 μm or less. The surface hardness of the pressing rotator 30 is preferably 40° or more and 60° or less (Asker C hardness). If the surface hardness is too large, it is difficult for the pressing rotator 30 to deform elastically, while if the surface hardness is too small, the pressure at the fixing nip N (hereinafter referred to as a nip pressure) is small.

The fixing device 1 further includes a sheet-shaped sliding member 70, a supporting member 90, and a lubricating member 60. The sliding member 70 is disposed between the inner peripheral surface of the fixing belt 10 and the pressing member 20. The sliding member 70 is generally composed of a glass cloth as a base material, and a sliding surface thereof is coated with fluorine-based resin. As the sliding member 70, a fluorine fiber fabric, a fluororesin sheet, a glass coat or the like may be used. The sliding member 70 is configured to reduce the sliding resistance between the inner peripheral surface of the fixing belt 10 and the pressing member 20 so as to allow the fixing belt 10 to rotate stably.

However, as the fixing belt 10 continues to slide on the sliding member 70, the sliding resistance may increase, which may cause the fixing belt 10 to rotate poorly. In order to prevent the fixing belt 10 from rotating poorly, a lubricant is applied between the fixing belt 10 and the sliding member 70. The lubricant may suppress the wearing between the fixing belt 10 and the sliding member 70, which makes it possible to improve the durability of the fixing belt 10 and the sliding member 70.

The lubricant is preferably a silicone-based or fluorine-based lubricant having high heat resistance, and more specifically, it is preferably fluorine grease. When the fluorine grease which has a high viscosity and contains a solid component is used as the lubricant, it tends to stay in the fixing nip N, which makes it possible to more effectively suppress the wearing between the fixing belt 10 and the sliding member 70 as compared with the case where oil is used as the lubricant.

In order to retain the lubricant in the fixing nip N, it is preferable that the surface of the sliding member 70 is provided with pimples and dimples. Although the size of the pimples and dimples is arbitrary, from the viewpoint of retaining the lubricant and preventing an image from becoming irregular by the pimples and dimples, the surface roughness Ra is preferably 1 μm or more and 50 μm or less.

The supporting member 90 is disposed at the downstream of the pressing member 20 in the rotation direction of the fixing belt 10 (in the direction indicated by an arrow C in FIG. 2). The supporting member 90 is configured to support the fixing belt 10 from the inner peripheral surface side of the fixing belt 10. The lubricating member 60 is provided in the supporting member 90.

The lubricating member 60 is arranged in contact with the inner peripheral surface of the fixing belt 10.

The lubricating member 60 is configured to retain a lubricant. The lubricating member 60 is preferably made of a fibrous material having high heat resistance such as aramid fiber or fluorine fiber and a porous material having high heat resistance such as silicone sponge.

In certain situations, the lubricant applied to the inner peripheral surface of the fixing belt 10 as described in the above may be pushed out from one or both ends of the fixing belt 10 in the width direction DR1 due to the pressure from the fixing nip N. Since the lubricating member 60 is disposed inside the inner peripheral surface of the fixing belt 10, it is possible for it to maintain a certain amount of lubricant on the inner peripheral surface of the fixing belt 10.

Since the lubricating member 60 is provided in the supporting member 90, it is possible for the lubricating member 60 to stably contact the fixing belt 10. Furthermore, if the lubricating member 60 is arranged substantially at the center of the supporting member 90 and configured to project in a direction away from the supporting member 90, it is possible for it to contact the fixing belt 10 further stably.

The fixing belt 10 is stretched over the heating roller 41, the pressing member 20, and the supporting member 90. The fixing belt 10 is driven to rotate (in the direction indicated by an arrow C in FIG. 2) in accordance with the rotation of the pressing rotator 30 by the frictional force resulted from the press contact with the pressing rotator 30 at the fixing nip N.

The plain paper P to which the toner image T is transferred is conveyed to pass through the fixing nip N in such a state that the surface to which the toner image T is transferred faces the heated fixing belt 10. While the plain paper P is being conveyed to pass through the fixing nip N, it is pressed and heated by the fixing belt 10. As a result, the toner image T is fixed on the plain paper P.

(Pressing Member 20)

Figure 4:
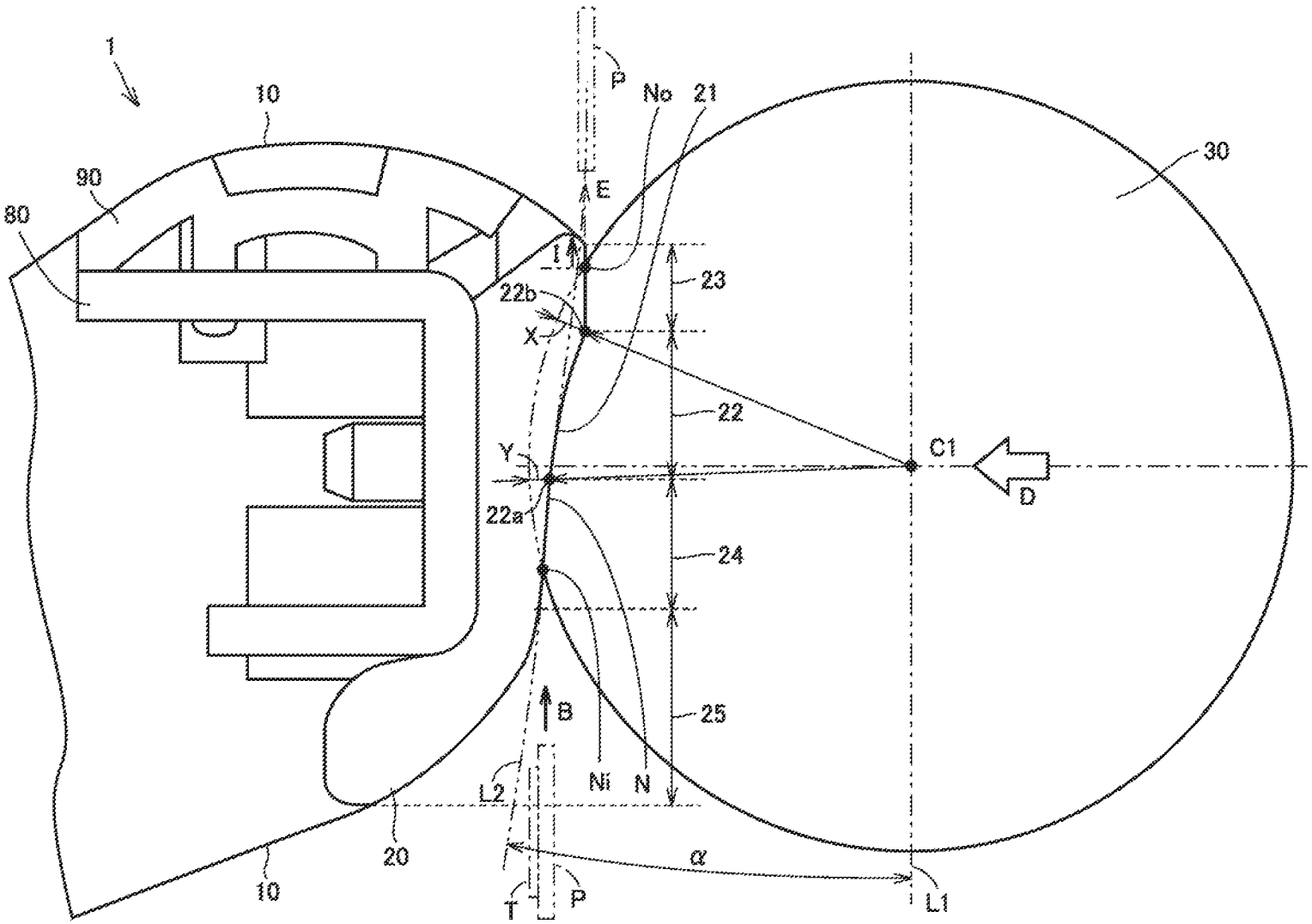
FIG. 4 is an enlarged view schematically illustrating a region IV illustrated in FIG. 2.

FIG. 4 is an enlarged view schematically illustrating a region IV illustrated in FIG. 2. In FIG. 4, the sliding member 70, the mandrel 30*a* and the elastic layer 30*b* are omitted to simply the explanation of the pressing member 20. The pressing rotator 30 illustrated in FIG. 4 is elastically deformed. In order to show the shape of the pressing rotator 30 before the elastic deformation, the shape thereof before the elastic deformation is indicated by a two-dot chain line.

The pressing member 20 has a counter face 21. The counter face 21 faces the inner peripheral surface of the fixing belt 10. The pressing rotator 30 is configured to undergo elastic deformation so as to follow the surface shape of the counter face 21. The counter face 21 has a nip upstream portion 25, a flat portion 24, a curved portion 22, and an extended portion 23.

The nip upstream portion 25 is provided at the most upstream position of the counter face 21 in the conveying direction of the plain paper P (the direction indicated by an arrow B in FIG. 4 which is simply referred to as the conveying direction hereinafter). The nip upstream portion 25 is curved. The fixing nip N is not formed in the nip upstream portion 25. The flat portion 24 is provided at the downstream of the nip upstream portion 25 in the conveying direction.

The flat portion 24 is smoothly continuous with the nip upstream portion 25. The flat portion 24 is substantially flat. The flat portion 24 extends substantially straight in a cross section of the pressing member 20 orthogonal to the width direction DR1 (hereinafter referred to as the cross section Z). In the cross section Z, the flat portion 24 is inclined relative to a virtual line L1 orthogonal to the direction (the direction indicated by a white arrow D in FIG. 4) along which the pressing rotator 30 presses the pressing member 20. In the cross section Z, the flat portion 24 is inclined in a direction approaching the virtual line L1 toward the downstream in the conveying direction. In the cross section Z, an angle $\alpha$ formed by a virtual extension line L2 in the direction along which the flat portion 24 extends and the virtual line L1 is, for example, 4.8°. The angle $\alpha$ is preferably 0.5° or more and 20° or less. The flat portion 24 is formed with an uppermost stream portion of the fixing nip N (hereinafter referred to as a nip inlet Ni). The curved portion 22 is provided at the downstream of the flat portion 24 in the conveying direction.

The curved portion 22 has an upstream end 22*a* and a downstream end 22*b*. The upstream end 22*a* is an upstream end of the curved portion 22 in the conveying direction. The downstream end 22*b* is a downstream end of the curved portion 22 in the conveying direction. The curved portion 22 is smoothly continuous with the flat portion 24 at the upstream end 22*a*. The curved portion 22 extends in the width direction DR1. The curved portion 22 is concavely curved. The curved portion 22 is recessed toward the fixing member 80. The curved portion 22 is formed by depressing the counter face 21 toward the fixing member 80.

The shape of the curved portion 22 in the cross section Z is configured to approach the center C1 of the pressing rotator 30 (bite into the outer peripheral surface of the pressing rotator 30) as it extends toward the downstream in the conveying direction. The amount of elastic deformation of the pressing rotator 30 in the region in contact with the curved portion 22 increases toward the downstream in the conveying direction. The amount of elastic deformation (indicated by X in FIG. 4) of the pressing rotator 30 at the downstream end 22*b* is larger than the amount of elastic deformation (indicated by Y in FIG. 4) of the pressing rotator 30 at the upstream end 22*a*.

According to the configuration mentioned above, the nip pressure at the curved portion 22 increases toward the downstream in the conveying direction. The curved portion 22 is a region that has a high nip pressure in the counter face 21. The nip pressure at the downstream end 22*b* of the curved portion 22 is highest in the curved portion 22. The extended portion 23 is provided at the downstream of the curved portion 22 in the conveying direction.

The extended portion 23 is continuous with the curved portion 22 at the downstream end 22*b*. The extended portion 23 extends from the downstream end 22*b* toward the downstream in the transport direction. The shape of the extended portion 23 in the cross section Z is configured to leave away from the center C1 of the pressing rotator 30 as it extends toward the downstream in the conveying direction. In the present embodiment, the extending direction of the extended portion 23 is substantially parallel to the extending direction of the virtual line L1.

In the present embodiment, the extended portion 23 is flat. The term "flat" as used herein means that a surface is roughly flat, and even when a surface has a slight curvature and is slightly curved, it is also referred to as being "flat". A part of the extended portion 23 constitutes a part of the fixing nip N. A part of the fixing nip N is formed in the extended portion 23. The extended portion 23 is formed with a region that is related to the fixing nip N and a region (non-fixing nip region) that is unrelated to the fixing nip N. The extended portion 23 is formed with a most downstream portion of the fixing nip N (hereinafter referred to as a nip outlet No).

The plain paper P fed from the nip inlet Ni is conveyed to pass through the fixing nip N, and is discharged from the nip outlet No (indicated by an arrow E in FIG. 4). The path along which the plain paper P is conveyed is defined by the surface shape of the counter face 21. The plain paper P is conveyed along the surface of the extended portion 23.

Figure 5:
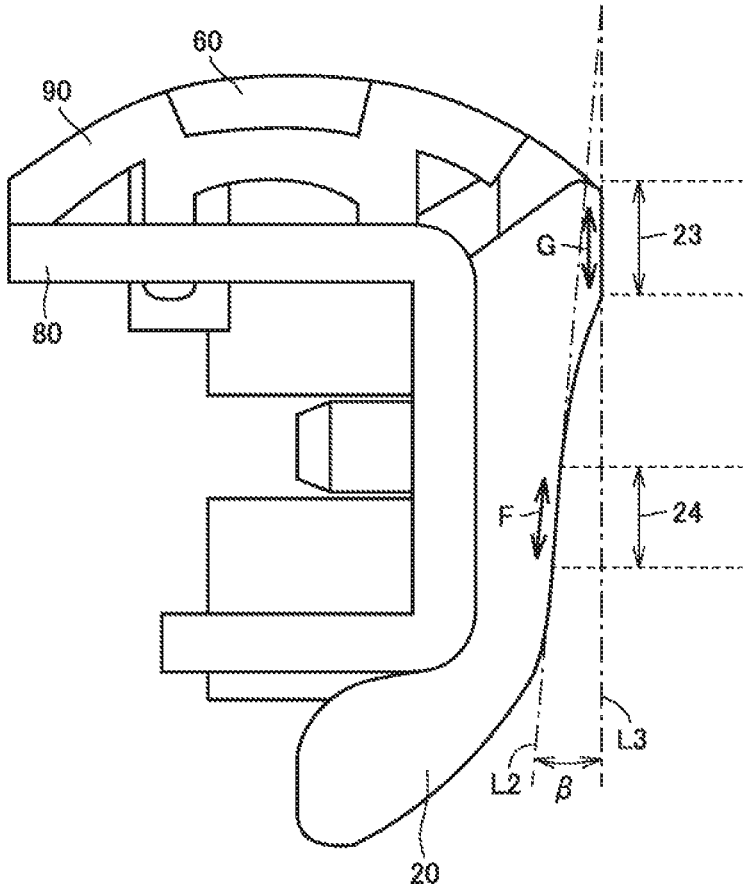
FIG. 5 is a schematic diagram illustrating the relationship between a flat portion and an extended portion.

FIG. 5 is a schematic diagram illustrating the relationship between the flat portion 24 and the extended portion 23. In the cross section Z, the flat portion 24 is inclined relative to the extended portion 23. In the cross section Z, an angle formed by the virtual extension line L2 in the direction (the direction indicated by an arrow F in FIG. 5) along which the flat portion 24 extends and a virtual extension line L3 in the direction (the direction indicated by an arrow G in FIG. 5) along which the extended portion 23 extends is, for example, 2.5°. The angle $\beta$ is preferably 0.5° or more and 10° or less.

Figure 6:
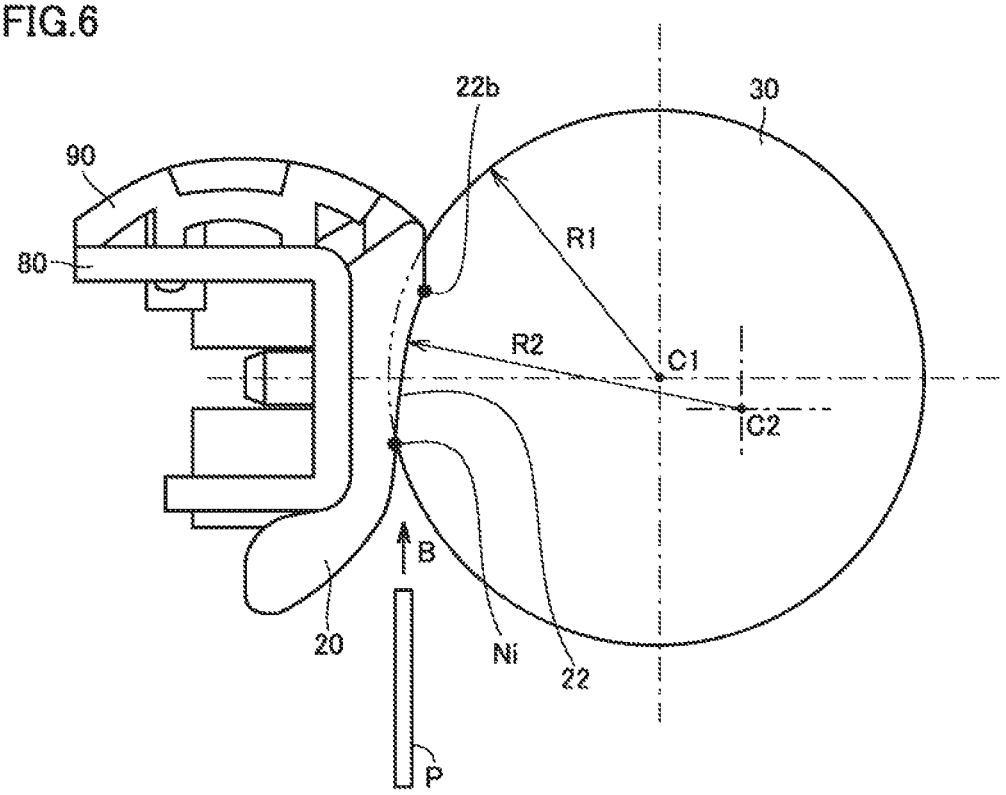
FIG. 6 is a schematic diagram illustrating the relationship between a curved portion and a pressing rotator.

FIG. 6 is a schematic diagram illustrating the relationship between the curved portion 22 and the pressing rotator 30. The curvature radius R2 of the curved portion 22 is larger than the radius R1 of the pressing rotator 30. The center C2 of the curvature circle of the curved portion 22 is located at the upstream of the center C1 of the pressing rotator 30 in the conveying direction of the plain paper P (the direction indicated by an arrow B in FIG. 6).

(Guide Member 50)

Figure 7:
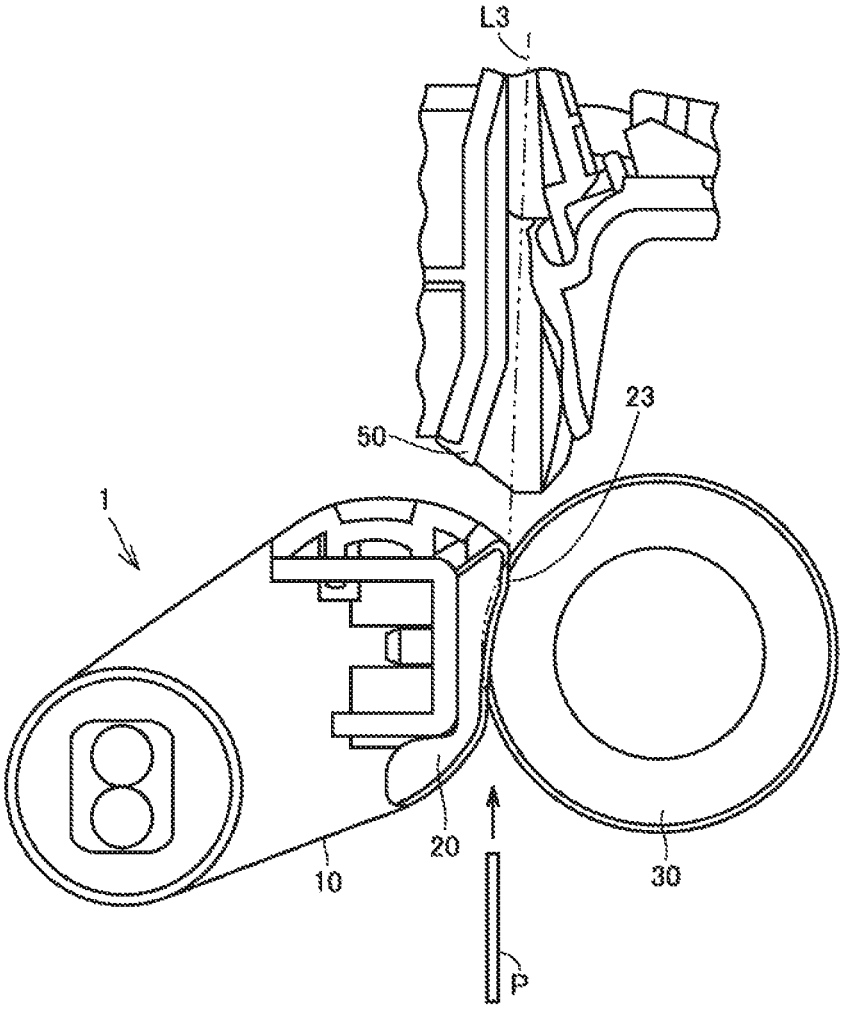
FIG. 7 is a diagram illustrating a conveying path of the recording medium immediately after it passes through a fixing nip.

FIG. 7 is a diagram illustrating a conveying path of the recording medium immediately after it passes through the fixing nip N. A guide member 50 configured to guide the plain paper P is provided at the downstream of the fixing device 1 in the conveying direction. The plain paper P passed the fixing nip N is further conveyed toward the downstream of the fixing device 1 in the direction along which the guide member 50 extends. The guide member 50 constitutes a part of the conveying path of the plain paper P. The virtual extension line L3 in the direction along which the extended portion 23 extends has no intersection with the guide member 50. The guide member 50 is not disposed at a position in the extending direction of the extended portion 23.

(Effects)

As illustrated in FIG. 4, when a high nip pressure is applied to the plain paper P at a position closer to the nip inlet Ni of the fixing nip N, the toner image T is fixed on the plain paper P (the toner image T is pushed into the fine pimples and dimples on the surface of the plain paper P) when only the surface portion of the toner image T is melted.

When only the surface portion of the toner image T is melted, it is difficult for the toner image to enter into the fine pimples and dimples on the surface of the plain paper P, which may result in poor fixing.

In the present embodiment, the curved portion 22 that is curved concavely is provided in the pressing member 20. Since the curved portion 22 is curved concavely, a pressure distribution may be formed in the fixing nip N in such a manner that the pressure gradually increases from the nip inlet Ni toward the downstream end 22*b* of the curved portion 22. Further, the pressure distribution may be formed in such a manner that the peak pressure is at a specific position (near the downstream end 22*b*). Furthermore, a region with a lower nip pressure (lower nip pressure region) may be formed in a portion of the fixing nip N that is closer to the nip inlet Ni, and a region with a higher nip pressure (higher nip pressure region) may be formed in a portion of the fixing nip N that is closer to the downstream end 22*b*.

By forming a lower nip pressure region (instead of a nip high pressure area) near the nip inlet Ni, it is possible to prevent the toner image T from being fixed on the plain paper P when only the surface portion of the toner image T is melted.

Since the higher nip pressure region is not formed near the nip inlet Ni, it is not necessary to raise the temperature of the fixing belt 10 so as to melt the whole toner image T near the nip inlet Ni. Thereby, it is possible to reduce the amount of heat required for fixing, which makes it possible to save energy.

By forming a lower nip pressure region near the nip inlet Ni and a higher nip pressure region near the downstream end 22*b*, the toner image T may receive heat from the fixing belt 10 so as to melt completely in the lower nip pressure region, and the completely melted toner image may be fixed on the plain paper P in the higher nip pressure region, which makes it possible to ensure satisfactory fixability.

Figure 8:
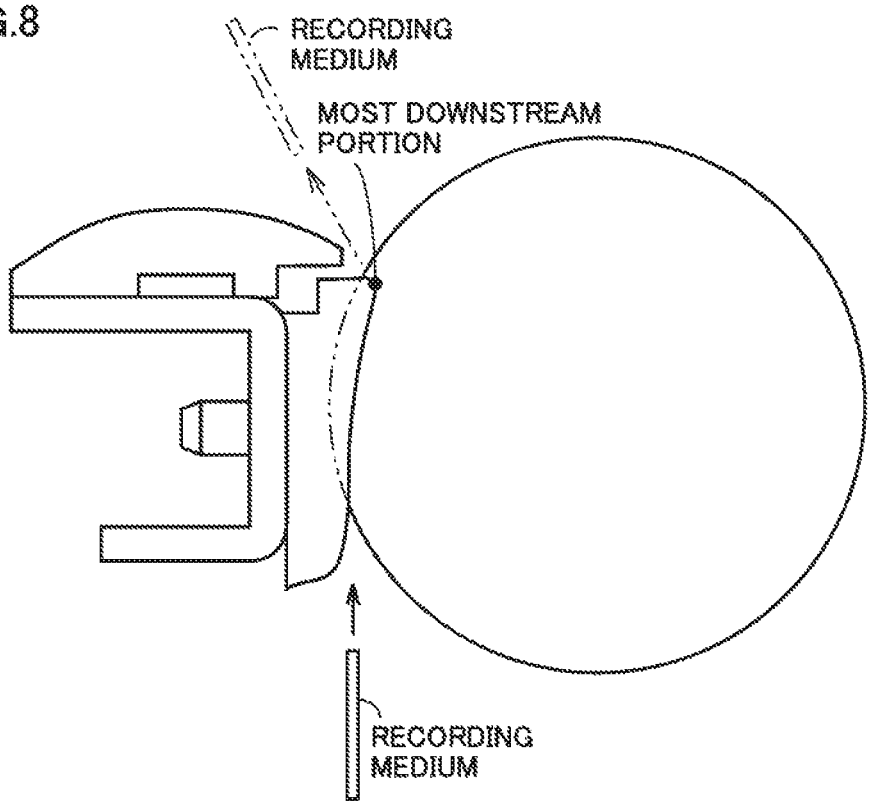
FIG. 8 is a cross sectional view schematically illustrating a conventional fixing device.

FIG. 8 is a cross sectional view schematically illustrating a conventional fixing device. The counter face of the pressing member in the conventional fixing device does not include an extended portion. Therefore, in the vicinity of the most downstream portion of the counter face in the conveying direction of the recording medium, the pressing rotator is configured to bite into the pressing member, and the recording medium may be conveyed closer to the fixing belt at the nip outlet. Since the recording medium is conveyed closer to the fixing belt, the recording medium may adhere to the fixing belt after passing through the nip outlet due to the adhesion of the toner image on the recording medium, which makes it impossible to ensure the separability between the recording medium and the fixing belt.

On the other hand, as illustrated in FIG. 4, in the present embodiment, the extended portion 23 is provided at the downstream of the curved portion 22. The plain paper P is conveyed along the surface shape of the extended portion 23. The extended portion 23 is configured to extend substantially straight from the downstream end 22*b* toward the downstream in the conveying direction, which makes it possible to stabilize the conveying path of the plain paper P while maintaining the pressure distribution in such a manner that the pressure gradually increases from the nip inlet Ni toward the downstream end 22*b* of the curved portion 22. Since the conveying path is stable, the plain paper P may be reliably conveyed toward the downstream of the fixing device 1. As a result, it is possible to ensure satisfactory separability between the plain paper P and the fixing belt 10.

As described above, by providing the extended portion 23 at the downstream of the curved portion 22 which is curved in a concave shape, it is possible to achieve both satisfactory fixability and separability.

It is preferable that the extended portion 23 is provided across both the fixing nip N and the non-fixing nip region. Since a part of the extended portion 23 is provided at the downstream of the nip outlet No in the conveying direction, the conveying path (indicated by an arrow I in FIG. 4) is defined to extend substantially straight from the nip outlet No, which makes it possible to further stabilize the conveying path of the plain paper P.

The extended portion 23 is preferably flat (i.e., the curvature is approximately 0). The plain paper P is conveyed along the surface shape of the pressing member 20. Therefore, when the extended portion 23 is flat, the plain paper P is conveyed straightly along the flat surface, which makes it possible to further stabilize the conveying path of the plain paper P and prevent the plain paper P from curving.

The extended portion 23 may be a mildly curved surface having a smaller curvature than the curved portion 22. Even with a mildly curved surface, it is possible to achieve both satisfactory fixability and separability.

Since the flat portion 24 is inclined relative to the virtual line L1, the amount of elastic deformation of the pressing rotator 30 at the flat portion 24 is smaller, which makes it possible to reduce the pressure near the nip inlet Ni. Thereby, the pressure near the downstream end 22*b* may be increased.

As illustrated in FIG. 6, since the curvature radius R2 of the curved portion 22 is larger than the radius R1 of the pressing rotator 30, it is possible to prevent the pressure from rising abruptly between the nip inlet Ni and the downstream end 22*b*.

Since the center C2 of the curvature circle of the curved portion 22 is located at the upstream of the center C1 of the pressing rotator 30 in the conveying direction, it is possible to gradually increase the pressure from the nip inlet Ni toward the downstream end 22*b*.

As illustrated in FIG. 7, the plain paper P immediately discharged from the fixing nip N does not come into contact with the guide member 50 that is arranged at the side of the fixing belt 10 relative to the virtual extension line L3. As a result, it is possible to prevent a conveyance failure (edge crease) from occurring due to the contact between the plain paper P discharged from the fixing device 1 and the guide member 50 and/or prevent an image noise from occurring due to the rubbing between the toner image fixed on the plain paper P and the guide member 50.

The surface hardness of the pressing rotator 30 is preferably 40° or more and 60° or less (Asker C hardness). As a result, a pressure distribution may be formed in such a manner that the pressure increases from the nip inlet Ni toward the downstream end 22*b*.

(Others)

When the extended portion 23 is a mildly curved surface having a curvature smaller than that of the curved portion 22, the extending direction of the extended portion 23 is the same as the conveying direction of the plain paper P at the downstream end of the extended portion 23.

It should be noted that the configurations, the materials and the like in the embodiments are merely examples, and they may be appropriately modified where necessary. The image forming apparatus 100 may be, for example, a monochrome or color copying machine, a monochrome or color printer, a monochrome or color facsimile machine, or a multi-function machine equipped with the copying machine and the printer and the facsimile machine.

EXAMPLES

Examples will be described Hereinafter. In the examples (Examples 1 to 3 and Comparative Examples 1 to 5), eight types of pressing members having different angles β formed between the flat portion and the extended portion were prepared and applied to the fixing device 1 illustrated in FIG. 2, respectively. After the plain paper was printed, a test was conducted to evaluate the peak pressure at the fixing nip and the curving degree (curl) of the plain paper.

FIG. 9 is a table listing the evaluation results of each pressing member according to Example 1 to Example 3 and Comparative Example 1 to Comparative Example 5. "Unacceptable" in FIG. 9 indicates that the fixing quality was poor due to the low peak pressure or that the printing quality was poor due to the curling of the plain paper. If it is determined that the evaluation result is satisfactory, it is denoted as "satisfactory", and if it is determined that the evaluation result is within an acceptable level, it is denoted as "acceptable".

When the angle β is a positive value, as illustrated in FIG. 5, the virtual extension line L2 is inclined in such a manner that it approaches the virtual extension line L3 toward the downstream in the conveying direction (i.e., the virtual line L2 is inclined in the clockwise direction toward the virtual extension line L3). When the angle β is a negative value, the virtual extension line L2 is inclined in such a manner that it leaves away from the virtual extension line L3 toward the downstream in the conveying direction (i.e., the virtual extension line L2 is inclined in the counterclockwise direction toward the virtual extension line L3).

Figure 10:
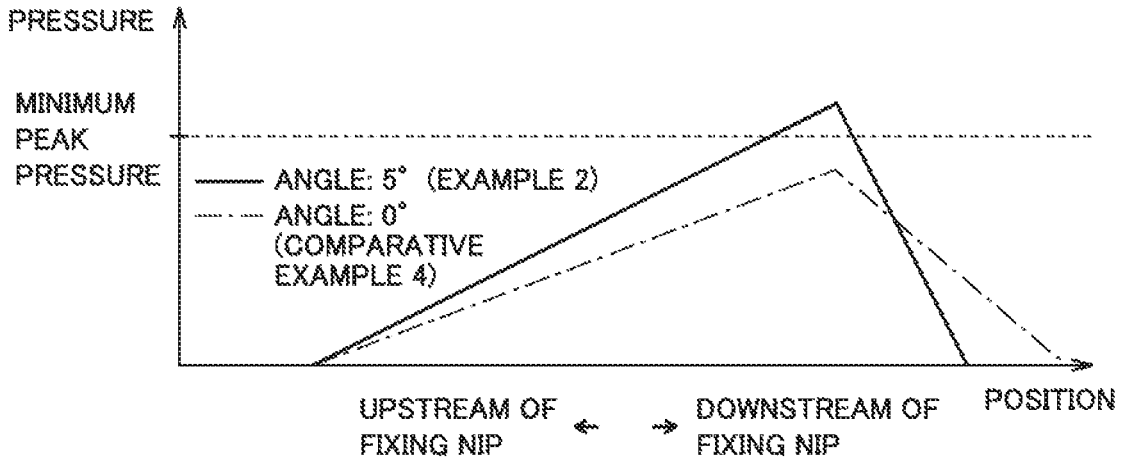
FIG. 10 is a schematic diagram illustrating the pressure distribution at the fixing nip when a pressing member of Example 2 and a pressing member of Comparative Example 4 are applied to the fixing device.

FIG. 10 is a schematic diagram illustrating the pressure distribution at the fixing nip when the pressing member according to Example 2 and the pressing member according to Comparative Example 4 are applied to the fixing device, respectively. FIG. 10 shows the pressure distribution when the flat portion is fixed and the extended portion is inclined. The dotted line in FIG. 10 shows a minimum peak pressure that prevents poor fixing from occurring.

The evaluation results will be discussed with reference to FIGS. 9 and 10. When the angle β is less than 0.5°, the amount of elastic deformation of the pressing rotator near the extended portion increases, and thereby, the nip pressure in a downstream region is greater than the peak pressure region (downstream end). Thus, the pressure is distributed in the downstream region other than the downstream end of the curved portion, and thereby, the peak pressure at the downstream end of the curved portion is low. On the other hand, when the angle β is 0.5° or more, a high peak pressure may be obtained at the downstream end, which makes it possible to ensure fixability.

However, when the angle β is larger than 10°, since the inclination of the conveying direction at the nip outlet relative to the conveying direction at the nip inlet is greater, the plain paper is conveyed with a great curvature. If the plain paper is heated in a curved state, it will be discharged in a curled state, resulting in a poor quality.

As described above, it was obvious that if the angle β is set to 0.5° or more and 10° or less, it is possible to improve fixability while ensuring printing quality.

As described above, the fixing device according to the present disclosure is configured to fix a toner image on a recording medium. The fixing device includes an endless fixing belt, a pressing member, a pressing rotator, and a heating unit configured to heat the fixing belt. The pressing member is disposed inside the inner periphery of the fixing belt. The pressing member includes a counter face that faces the inner peripheral surface of the fixing belt. The pressing rotator is disposed to face the pressing member with the fixing belt interposed therebetween. The pressing rotator forms a fixing nip with the pressing member. The counter face includes a curved portion that is concavely curved and an extended portion. The shape of the curved portion in a cross section of the pressing member orthogonal to the width direction of the fixing belt is configured to approach the center of the pressing rotator as it extends toward the downstream in the conveying direction. The extended portion is continuous with the curved portion. The extended portion is provided at the downstream of the curved portion in the conveying direction of the recording medium. The shape of the extended portion in the cross section is configured to leave away from the center of the pressing rotator as it extends toward the downstream in the conveying direction.

According to the fixing device, it is possible to stabilize the conveying path of the recording medium while maintaining the pressure distribution in such a manner that the pressure gradually increases from the nip inlet to the downstream end of the curved portion. Thereby, it is possible to achieve both satisfactory fixability and separability.

In the fixing device, a part of the extended portion constitutes a part of the fixing nip. Thereby, it is possible to further stabilize the conveying path of the recording medium.

In the fixing device, the extended portion has a smaller curvature than the curved portion. Thereby, it is possible to achieve both satisfactory fixability and separability.

In the fixing device, the extended portion is flat. Thereby, it is possible to further stabilize the conveying path of the recording medium and prevent the recording medium from curving.

In the above fixing device, a guide member configured to guide the recording medium is provided at the downstream of the fixing device in the conveying direction. In the cross section, a virtual extension line in a direction along which the extended portion extends has no intersection with the guide member. Thereby, it is possible to prevent a conveyance failure from occurring and/or prevent an image noise from occurring due to the rubbing between the toner image fixed on the recording medium and the guide member.

In the fixing device, the counter face further includes a flat portion provided at the upstream of the curved portion in the conveying direction. The flat portion is continuous with the curved portion. In the cross section, the flat portion is inclined relative to a virtual line orthogonal to a direction along which the pressing rotator presses the pressing member. In the cross section, the flat portion is inclined in such a manner that it approaches the virtual line toward the downstream in the conveying direction. Thereby, the amount of elastic deformation of the pressing rotator at the flat portion is reduced, which makes it possible to reduce the pressure near the nip inlet.

In the fixing device, an angle formed between the extended portion and the flat portion in the cross section is 0.5° or more and 10° or less. As a result, it is possible to improve fixability while ensuring printing quality.

In the fixing device, the curvature radius of the curved portion is larger than the radius of the pressing rotator. Thereby, it is possible prevent the pressure from rising abruptly between the nip inlet and the downstream end.

In the fixing device, the center of the curvature circle of the curved portion is located at the upstream of the center of the pressing rotator in the conveying direction. As a result, it is possible to gradually increase the pressure from the nip inlet toward the nip outlet.

An image forming apparatus of the present disclosure includes the fixing device according to any of the above aspects and a housing unit configured to house the recording medium. Thereby, it is possible to implement an image forming apparatus capable of providing both satisfactory fixability and separability.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing device configured to fix a toner image on a recording medium, comprising:

an endless fixing belt;

a pressing member that is disposed inside the inner periphery of the fixing belt and includes a counter face that faces the inner peripheral surface of the fixing belt;

a pressing rotator that is disposed to face the pressing member with the fixing belt interposed therebetween and configured to form a fixing nip with the pressing member; and a heating unit configured to heat the fixing belt, the counter face including a curved portion that is concavely curved and an extended portion that is continuous with the curved portion and is provided at the downstream of the curved portion in the conveying direction of the recording medium, the shape of the curved portion in a cross section of the pressing member orthogonal to the width direction of the fixing belt being configured to approach the center of the pressing rotator as it extends toward the downstream in the conveying direction, and the shape of the extended portion in the cross section being configured to leave away from the center of the pressing rotator as it extends toward the downstream in the conveying direction.

2. The fixing device according to claim 1, wherein a part of the extended portion constitutes a part of the fixing nip.

3. The fixing device according to claim 1, wherein the extended portion has a smaller curvature than the curved portion.

4. The fixing device according to claim 3, wherein the extended portion has a flat shape.

5. The fixing device according to claim 1, wherein a guide member configured to guide the recording medium is provided at the downstream of the fixing device in the conveying direction, and in the cross section, a virtual extension line in a direction along which the extended portion extends has no intersection with the guide member.

6. The fixing device according to claim 1, wherein the counter face further includes a flat portion provided at the upstream of the curved portion in the conveying direction, the flat portion is continuous with the curved portion, the flat portion in the cross section is inclined relative to a virtual line orthogonal to a direction along which the pressing rotator presses the pressing member, and the flat portion in the cross section is inclined in such a manner that it approaches the virtual line toward the downstream in the conveying direction.

7. The fixing device according to claim 6, wherein an angle formed between the extended portion and the flat portion in the cross section is 0.5° or more and 10° or less.

8. The fixing device according to claim 1, wherein the curvature radius of the curved portion is larger than the radius of the pressing rotator.

9. The fixing device according to claim 1, wherein the center of a curvature circle of the curved portion is located at the upstream of the center of the pressing rotator in the conveying direction.

10. An image forming apparatus:

the fixing device according to claim 1; and a housing unit configured to house the recording medium.

* * * * *